US005426822A

United States Patent [19]

Weir

[11] Patent Number: 5,426,822

[45] Date of Patent: Jun. 27, 1995

[54] HINGE STRUCTURE

[76] Inventor: Richard L. Weir, 2217 Grant Ave., Dayton, Ohio 45406

[21] Appl. No.: 44,777

[22] Filed: Apr. 12, 1993

Related U.S. Application Data

[63] Continuation-in-part of Ser. No. 665,020, Mar. 5, 1991, Pat. No. 5,228,278, Ser. No. 546,672, Jun. 28, 1990, abandoned, and Ser. No. 276,197, Nov. 4, 1988, abandoned.

[51] Int. Cl.[6] ..... E05D 5/14; E04C 3/11

[52] U.S. Cl. ..... 16/392; 16/390; 16/221; 52/640; 52/645

[58] Field of Search ..... 52/640, 645, 647, 712, 52/713, 92.1, 702; 16/252, 392 OR, 390, 221

[56] References Cited

U.S. PATENT DOCUMENTS

| | | | |
|---|---|---|---|
| 1,163,641 | 8/1914 | Cummings | 52/640 |
| 3,749,428 | 7/1973 | Hustead | 52/645 |
| 3,785,108 | 1/1974 | Satchell | 52/640 |
| 4,393,637 | 7/1983 | Mosier | 52/640 |
| 4,513,474 | 4/1985 | Watabe | 16/252 |
| 4,872,297 | 10/1989 | Hetzel et al. | 52/645 |
| 5,094,059 | 3/1992 | Ganescu | 52/645 |
| 5,199,218 | 4/1993 | McQuade | 16/392 |

FOREIGN PATENT DOCUMENTS

| | | | |
|---|---|---|---|
| 518598 | of 1953 | Belgium | 52/645 |

*Primary Examiner*—Carl D. Friedman
*Assistant Examiner*—Wynn E. Wood
*Attorney, Agent, or Firm*—Donald P. Gillette

[57] ABSTRACT

A hinge structure having a leaf having knuckles so formed that leaves having two identical such knuckle structures can be joined together to form a hinge, rather than requiring knuckle structures that are not identical. The hinge structure can have plates to hold beams in alignment to form a structure that is initially pivotal but, with the addition of other beams or structures, can be rigid and with the beams at any desired angle relative to each other.

12 Claims, 3 Drawing Sheets

HINGE STRUCTURE

This is a continuation in part to application Ser. Nos. 276,197 of Nov. 4, 1988, now abandoned; 546,672 of Jun. 27, 1990, now abandoned; and 665,020 of Mar. 5, 1991, now U.S. Pat. No. 5,228,278.

DESCRIPTION

In my Variable Pitch Saddle Hinge Roof Truss Connector System it is to be noted that the wall header plates, which are attached to the wall header, have identical hinge matching elements to the basic hinge. Any desired roof pitch may thus be provided by altering the lengths of the truss elements, which are normally of the same thickness. As only two different parts, the wall header hinge adapter plate and the basic hinge part, in addition to the hinge pin, are required for truss fabrication, production costs can be kept to a minimum while providing extreme flexibility in roof truss design.

IN THE DRAWINGS

IN DETAIL THEN

Figure 1:
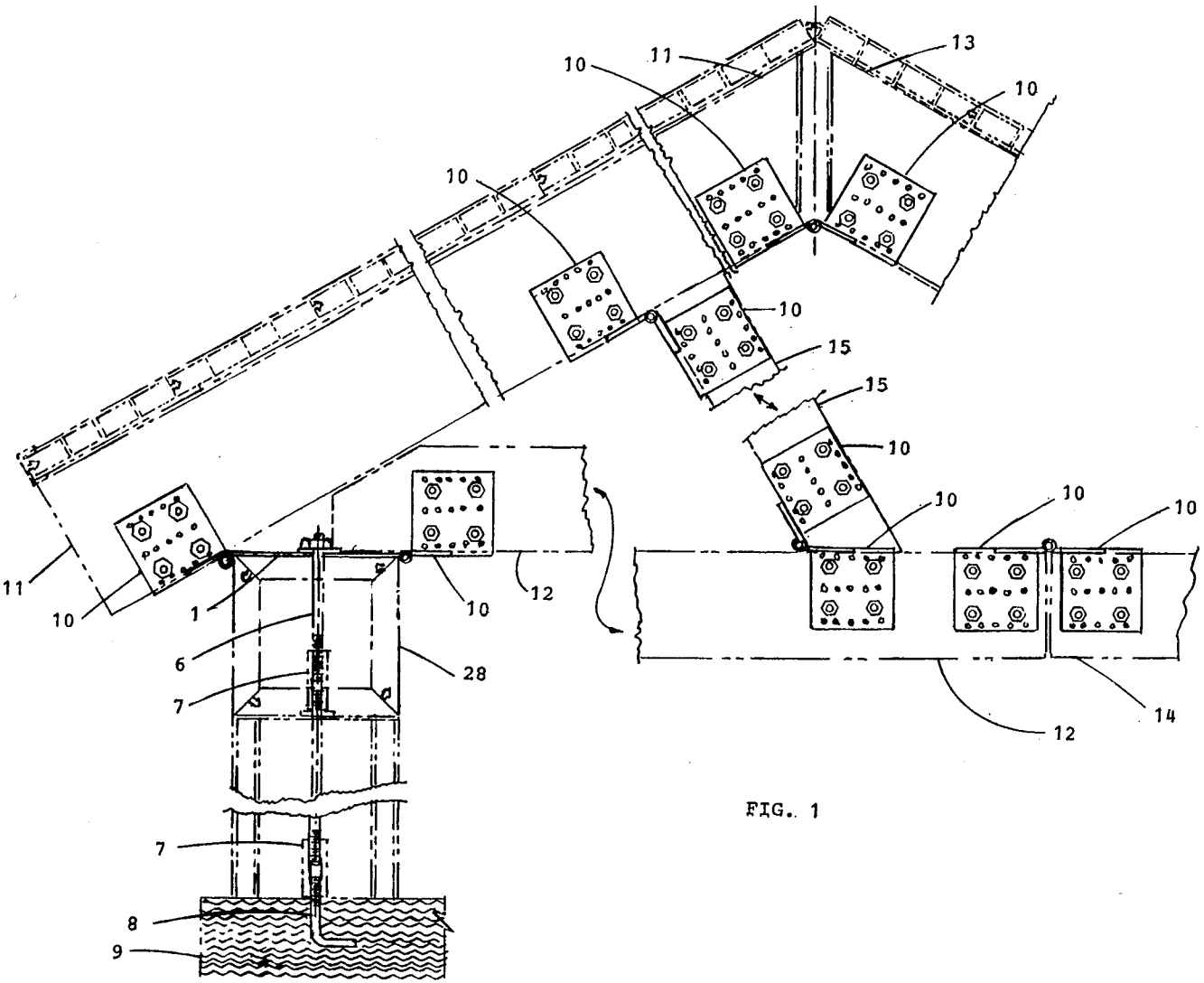
FIG. 1 is a side view assembly drawing showing the various truss elements connected to each other and to the side wall assembly header.
Figure 5:
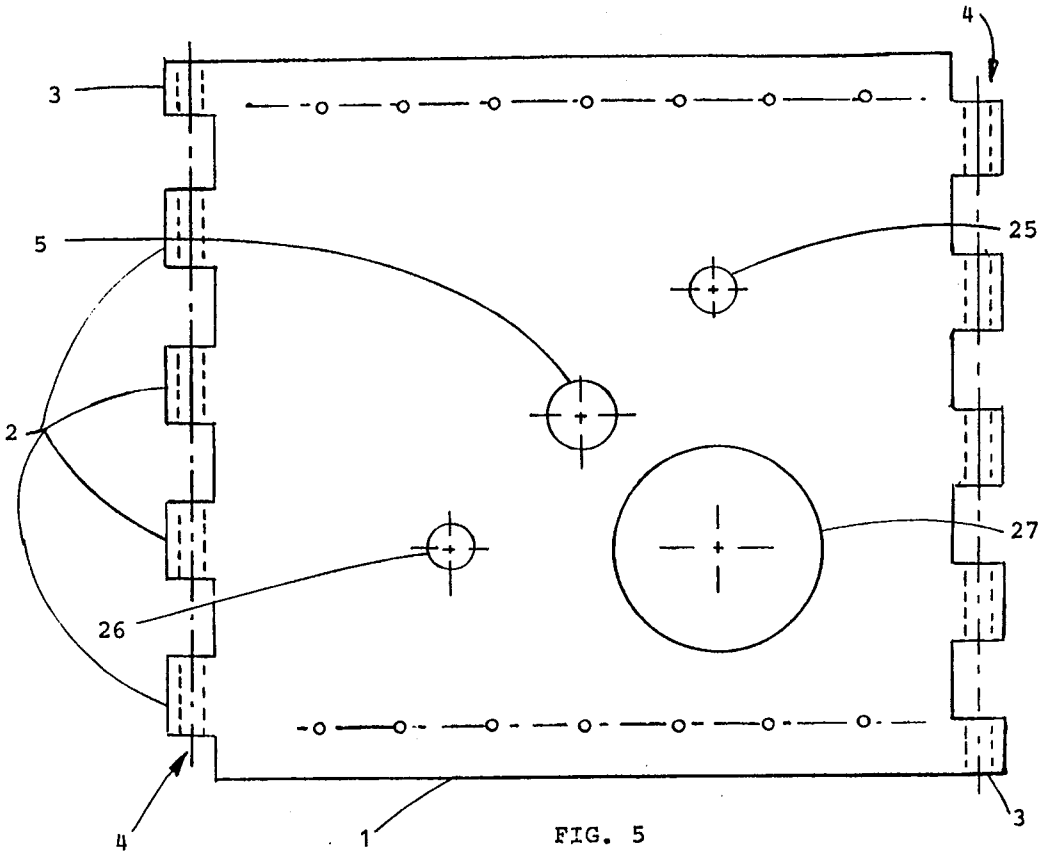
FIG. 5 is a top view of the wall header hinge adapter plate.
Figure 6:
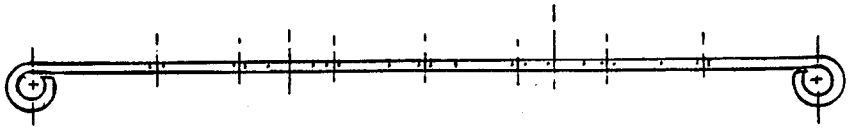
FIG. 6 is a side view of the wall header hinge adapter plate.

Wall header hinge adapter plate 1 (FIGS. 1 & 5) has downwardly extending hollow cylindrical adapter sections 2 on both sides of the plate 1. A half cylindrical section 3 is provided on the opposite corners of the plate 1 and half hollow cylindrical pin adapter spaces 4 and 13 on the other opposite corners. A central hole 5 is provided for insertion of the header to footer tie down bolt 6 (FIG. 1). Appropriately internally threaded sleeves 7 are provided for the attachment to the threaded "J" bolt 8, which in turn is embedded in the concrete building slab 9.

Figure 4:
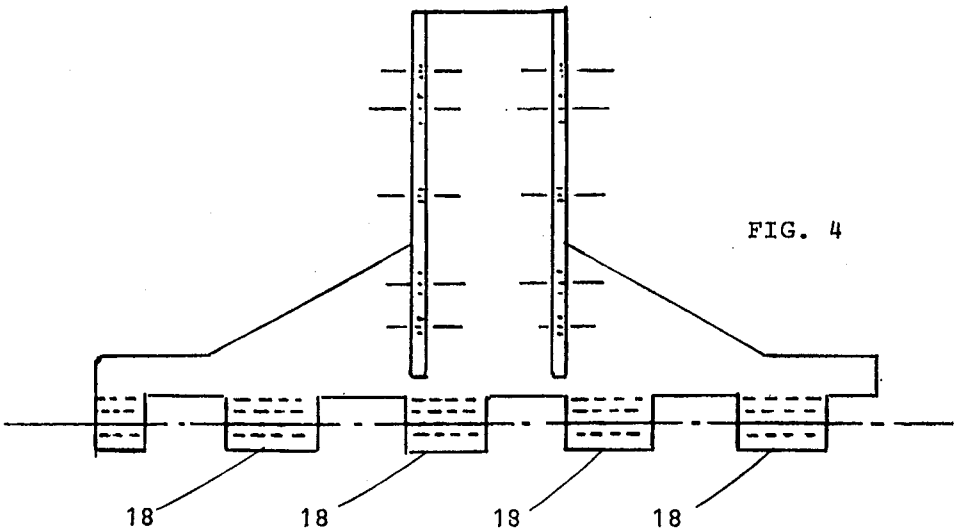
FIG. 4 is a top view of the basic hinge element with "U" shaped saddle adapter.
Figure 3:
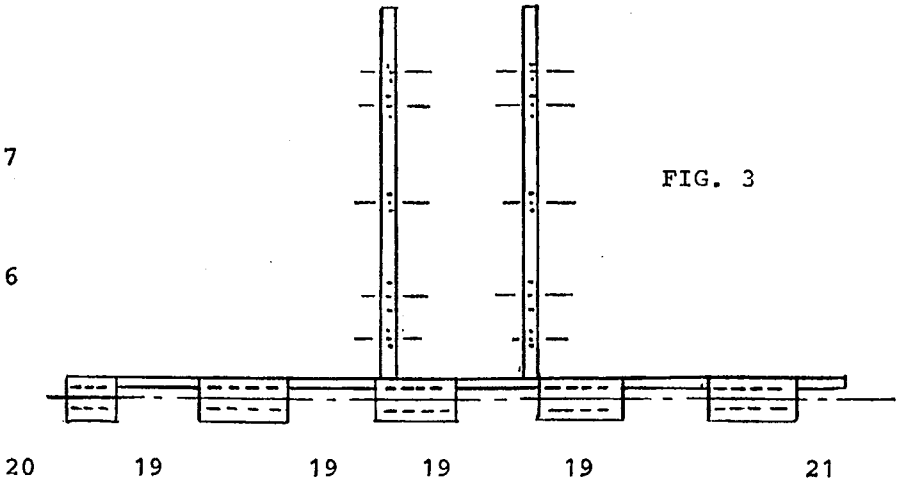
FIG. 3 is an end view of the basic hinge element with "U" shaped saddle adapter.
Figure 2:
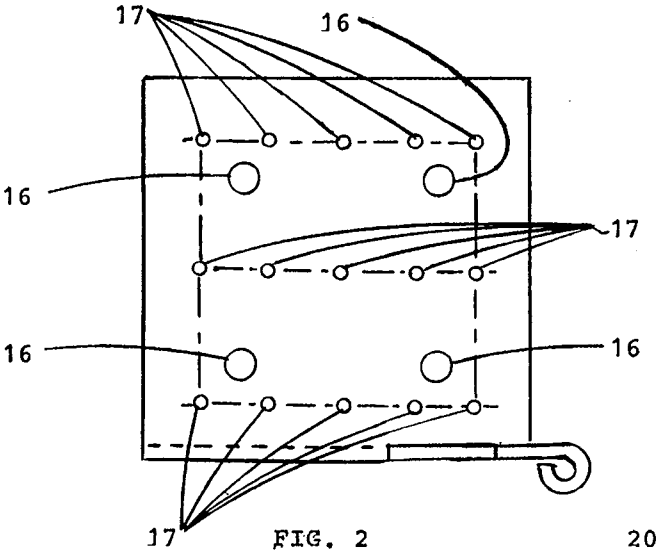
FIG. 2 is a side view of the basic hinge element with "U" shaped saddle adapter.
Figure 7:
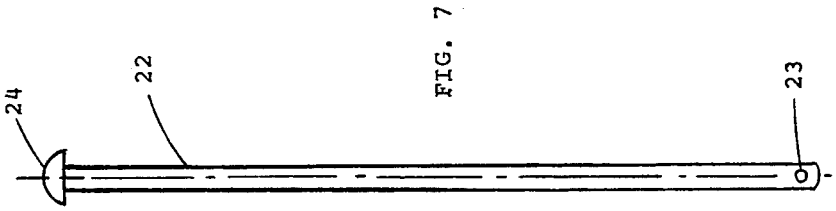
FIG. 7 is a side view of the hinge pin.

Saddle hinge adapter 10 connects the wall header adapter plate 1 to the sloping truss member 11 and the truss cross member 12. At the peak of the roof sloping truss members 11 and 13 are also connected by hinge adapters 10. Lower truss members 12 and 14 may also be connected by truss members 10. Truss brace 15 may be connected to sloping truss member 11 and lower truss member 12 by hinge adapters 10. It is to be noted that hinge adapters 10 have holes 16 (FIG. 2) for insertion of bolts thru appropriately bored holes in the truss members 11, 12, 13, 14 and 15 to assemble the truss members. Nailing or screw holes 17 are also provided as an alternate assembly means. As noted in FIGS. 3 and 4 the downwardly extending hollow cylindrical hinge sections 18 are sized to fit within the slots 19 of adjoining hinge sections. The half slot 21 will accept the half hollow cylindrical hinge section 20 which will fit within slot 21 when two hinge sections are joined by round hinge pin 22. Round hinge pin 22 has cotter key hole 23 provided near the end. A conventional button head 24 is provided at the opposite end of hinge pin 22.

Additional holes 25 and 26 are provided in the wall header adapter plate 1 for bolts to allign adjoining structural box beam sections 28 and a large hole 27 is provided for concrete fill, with matching holes (not shown) in the box beam header.

In essence then, the truss connector system depicted herein, will provide an inexpensive new and novel way of assembling roof trusses, for conventional or special wall systems. The parts can be shipped as individual pieces and easily assembled by the unskilled at on site locations. Any desired roof slope may be provided by changing the length of roof truss members.

I claim:

1. A hinge structure comprising:

(a) a leaf comprising first and second surfaces; and (b) a set of knuckles in a straight row along one edge of the leaf, each of the knuckles being cylindrically curved to define a cylindrical space, all of the knuckles having the same radius of curvature and a common axis, a first one of the knuckles at one end of the row having a certain axial length, and each of the other knuckles having an axial length twice as great as the axial length of the first knuckle, each of the knuckles, including the first knuckle, being separated axially from the knuckle next-adjacent thereto by a distance at least twice as great as the axial length of the first knuckle.

2. The hinge structure of claim 1 in which:

(a) said edge of the leaf has first and second ends and a length from the first end to the second end equal to an integral multiple of twice the axial length of the first knuckle;

(b) the first knuckle is at the first end of the edge; and (c) the axial distance between the second end of the edge of the leaf and the proximal end of the knuckle nearest thereto is at least as great as the axial length of the first knuckle.

3. The hinge structure of claim 1 comprising, in addition, a plate extending from the first surface of the leaf in a direction perpendicular to the first surface and perpendicular to said axis and having mounting hole means through the plate to allow fastening means to pass therethrough to secure the plate to support means.

4. The hinge structure of claim 3 comprising, in addition, a second plate extending from the first surface parallel to the first-named plate and having mounting hole means aligned with the mounting hole means of the first-named plate, the plates being spaced apart to allow the support means to be secured between them.

5. The hinge structure of claim 3 in which the first-named plate and the second plate are spaced equidistantly from a central plane parallel to the plates and perpendicular to the leaf.

6. The hinge structure of claim 1 comprising, in addition:

(a) a second leaf comprising first and second surfaces; and (b) a second set of knuckles in a straight row along one edge of the second leaf, each of the second set of knuckles being cylindrically curved to define a cylindrical space, all of the knuckles in the second set having the same radius of curvature as the radius of curvature of the knuckles of the first set, a first one of the knuckles of the second set at one end of the second row having an axial length equal to the axial length of the first knuckle of the first set of knuckles, and each of the other knuckles of the second set having an axial length twice as great as the axial length of the first knuckle of the first set, each of the knuckles of the second set, including the first knuckle of the second set, being separated from the knuckle next-adjacent thereto in the second set by a distance at least twice as great as the axial length of the first knuckle in the first set, whereby the first and second sets knuckles can be interleaved to define a barrel having a single axis; and (c) a pin extending through the barrel and having a diameter less than the diameter of the cylindrical space defined by each of the sets of knuckles.

7. A hinge structure according to claim 6 in which said edge of the second leaf as a length equal to an integral multiple of twice the axial length of the first knuckle of the first set.

8. The hinge structure according to claim 6 in which said edge of the first-named leaf has the same axial length as said edge of the second leaf.

9. The hinge structure of claim 6 in which the first-named leaf is identical to the second leaf.

10. The hinge structure according to claim 6 in which the length of the barrel is an integral multiple of twice the length of the first knuckle of the first set.

11. The hinge structure of claim 10 comprising:

(a) first and second plates perpendicular to the first-named leaf and integrally attached thereto and spaced equidistantly on opposite sides of a central plane that passes through the center of the barrel perpendicularly to the axis thereof;

(b) a first plurality of openings in the first plate;

(c) a second plurality of openings in the second plate aligned with the first plurality of openings to receive assembly means therethrough;

(d) third and fourth plates perpendicular to the second leaf and integrally attached thereto and spaced equidistantly on opposite sides of the central plane, the distance between the first and second plates being equal to the distance between the third and fourth plates;

(e) a third plurality of openings in the third plate; and (f) a fourth plurality of openings in the third plate aligned with the third plurality of openings to receive assembly means therethrough.

12. The hinge structure of claim 11 comprising:

(a) a first beam having a thickness, the first and second plates being on opposite sides of the beam and being spaced apart a distance equal to the thickness of the first beam, whereby the first and second plates are in contact with opposite sides of the beam;

(b) first assembly means through the first and second aligned openings of the first and second plates and through the beam therebetween;

(c) a second beam having the same thickness as the first beam, the third and fourth plates being on opposite sides of the second beam and in contact therewith;

(d) second assembly means through the third and fourth aligned openings of the third and fourth plates and through the second beam therebetween; and (e) a pin through the barrel to hold the first beam in fixed pivotal position relative to the second beam.

* * * * *